United States Patent [19]

Deason

[11] 4,395,014

[45] Jul. 26, 1983

[54] POOL DECK FORM FOR VINYL LINER SWIMMING POOL

[76] Inventor: Max W. Deason, 1818 W. Price St., Tucson, Ariz. 85705

[21] Appl. No.: 322,394

[22] Filed: Nov. 17, 1981

[51] Int. Cl.[3] ..... E04B 1/16

[52] U.S. Cl. ..... 249/9; 249/10; 249/19; 249/90; 249/190; 249/211; 249/DIG. 3

[58] Field of Search ..... 249/9, 10, 19, 90, 211, 249/213, 214, DIG. 3, 190

[56] References Cited

U.S. PATENT DOCUMENTS

| | | | |
|---|---|---|---|
| 3,206,823 | 9/1965 | Walter | 249/10 |
| 3,348,801 | 10/1967 | Deason | 249/19 |
| 3,526,070 | 9/1970 | Deason | 249/DIG. 3 |
| 3,633,867 | 1/1972 | Eriksson | 249/213 |
| 3,850,403 | 11/1974 | Stegmeier | 249/19 |
| 3,850,404 | 11/1974 | Stegmeier | 249/19 |
| 3,904,717 | 9/1975 | Stegmeier | 249/DIG. 3 |
| 3,920,214 | 11/1975 | Louisa | 249/213 |
| 3,967,422 | 7/1976 | Stegmeier | 249/19 |
| 4,066,237 | 1/1978 | Bentz | 249/213 |
| 4,159,097 | 1/1979 | Strickland | 249/213 |

*Primary Examiner*—John A. Parrish

*Attorney, Agent, or Firm*—Drummond, Nelson & Nissle

[57] ABSTRACT

Improved apparatus for forming the deck and associated coping of a pool. The pool defines and encloses a central area for receiving and retaining water and includes a substantially vertical wall; a horizontal support surface adjacent to and intersecting the pool wall to define a horizontal edge at the top of the wall; a flexible sheet of waterproof material for lining the pool, the liner having a peripheral edge; and a liner retainer secured to and extending continuously along the horizontal support surface adjacent the horizontal edge of the pool wall and having a channel extending along the length thereof contoured to receive the peripheral edge of the liner, the channel opening toward the central area of the pool. The improved apparatus includes a continuous strip of semirigid material and an elongate member for supporting the strip. The continuous strip of semirigid material includes a facing surface which is positioned below the horizontal edge against the upper portion of the pool wall; a front form surface extending upwardly from the facing surface to form a contoured surface for temporarily supporting concrete poured above the horizontal edge onto the horizontal support surface, the concrete forming a pool deck and coping thereof contiguous to the pool wall when set; and a back wall surface generally opposed to the front form surface and facing the central area of the pool. The elongate support member passes through the strip of semirigid material and is secured to the liner retainer to maintain the semirigid strip in position against the pool wall.

6 Claims, 4 Drawing Figures

POOL DECK FORM FOR VINYL LINER SWIMMING POOL

This invention pertains to apparatus for forming a deck and its associated coping along the upper horizontal edge of the wall of a pool constructed to be lined with a flexible, waterproof sheet of material, the pool including a liner retainer extending along the upper edge of the pool wall and having a continuous channel formed along the length thereof to receive the peripheral edge of the pool liner.

More particularly, the invention pertains to apparatus which includes elongate support members and includes a semirigid pool deck strip form having a facing surface which is positioned against the pool wall just below the upper edge thereof and having a contoured form surface extending upwardly from the facing surface to contain concrete poured on a horizontal support surface surrounding the pool, the elongate support members temporarily holding the form strip in position against the upper portion of the pool wall.

In a further respect, the invention pertains to pool deck construction apparatus of the type described in which the facing surface of a semirigid pool deck strip form is effectively maintained in position against a pool wall either when a thin oil-like film covers the pool wall or when the pool wall is curved.

In another respect, the invention pertains to pool deck construction apparatus of the type described in which each elongate support member has one end which passes through the semirigid strip form and is adapted to be secured in the channel of the liner retainer strip, the support member holding the form strip in position against the upper portion of the pool wall when said end is secured in the channel of the liner retainer strip.

In still another respect, the present invention pertains to pool deck construction apparatus of the type described in which the support members are readily disengaged from the channel of the liner retainer such that the semirigid strip form can be quickly and conveniently removed after poured concrete has set to form the pool deck and coping.

In yet another respect, the invention pertains to pool deck construction apparatus which can be quickly installed by relatively unskilled persons without requiring the use of any tools whatsoever.

So-called "liner pools" or pools designed to be lined with a flexible sheet of vinyl or other waterproof material pose special problems in constructing the concrete decks and associated coping which extend along the upper edge of the pool wall. Typically, both the pool wall and the horizontal support surface which surrounds the upper edge of the pool wall and on which concrete is poured to form the pool deck are metal. Since the issuance of my U.S. Pat. No. 3,526,070, semirigid polystyrene form strips have commonly been utilized to form the deck and associated coping for gunite walled swimming pools and for less expensive liner pools. These semirigid polystyrene strip forms include a facing surface which is positioned against the pool wall just below the upper edge of the wall and includes a contoured form surface which extends upwardly from the facing surface to temporarily contain and support concrete poured on the horizontal support surface extending around the upper edge of the pool wall. Pressure sensitive adhesive carried by the facing surface of the strip form bonds to the upper portion of the pool wall to maintain the form in position on the wall. After the poured concrete has set, the polystyrene strip and adhesive are readily peeled from the wall of the pool.

The pressure sensitive adhesive carried on the facing surface of the polystyrene strip form normally adheres to metal walls utilized in vinyl liner pools. However, around curved portions of the pool wall and when liquid or oil-like films coat the surface of metal wall, the adhesive may not fully bind to the metal and can separate therefrom after concrete is poured onto the horizontal support surface around the upper edge of the wall and is bearing against the upstanding contoured form surface of the polystyrene strip.

In addition, hydrokinetic forces exerted against the strip form while concrete is being poured and hydrostatic forces exerted by the concrete after it has been poured tend to bend the upper contoured portion of the lightweight polystyrene form away from the upper edge of the pool wall and toward the center of the pool, causing the resulting concrete coping to be improperly formed.

Although various types of supplemental bracing systems have been utilized to provide additional support for semirigid pool deck strip forms positioned against the upper portion of a pool wall, these systems are generally time consuming and unwieldly in use.

Accordingly, it would be highly desirable to provide inexpensive, readily installed pool deck strip form apparatus which could be maintained in position against the upper portion of the wall of a pool constructed to be lined with a flexible sheet of waterproof material.

It would also be highly desirable to provide pool deck strip form apparatus which could be easily installed and maintained in position against the upper portion of the wall of a vinyl liner pool even when a thin film of oil or other foreign matter was on the surface of the pool wall.

Therefore, it is a principal object of the instant invention to provide improved apparatus for forming the pool deck and associated edging of a pool constructed to be lined with a flexible, waterproof sheet of material, the pool including a liner retainer extending along the upper edge of the pool wall and having a channel formed along the length thereof to receive the peripheral edge of the pool liner.

Another object of the invention is to provide pool deck construction apparatus which includes a semirigid form having a facing surface positioned against the upper portion of the pool wall and also having a contoured form surface extending upwardly from the facing surface to temporarily contain and support concrete poured above the upper edge of the pool, and includes associated structural elements for holding the semirigid form in position against the upper portion of the pool wall when concrete is poured and bears against the upstanding contoured surface of the strip form.

A further object of the instant invention is to provide apparatus of the type described in which the supplemental structural members which support the semirigid form strip in position against the pool wall are inexpensive in manufacture and can be quickly and conveniently installed by persons of limited mechanical skill without the use of conventional hand tools.

Still another object of the invention is to provide auxiliary support members for semirigid strip form of the type described which includes an end that passes through the form strip and is adapted to detachably, fixedly engage the channel of the liner retainer strip, the support member holding the form strip in position against the upper portion of the pool wall when said end is secured in the channel of the liner retainer strip.

These and other, further and more specific objects and advantages of the invention will be apparent to those skilled in the art from the following detailed description thereof, taken in conjunction with the drawings, in which.

Figure 1:
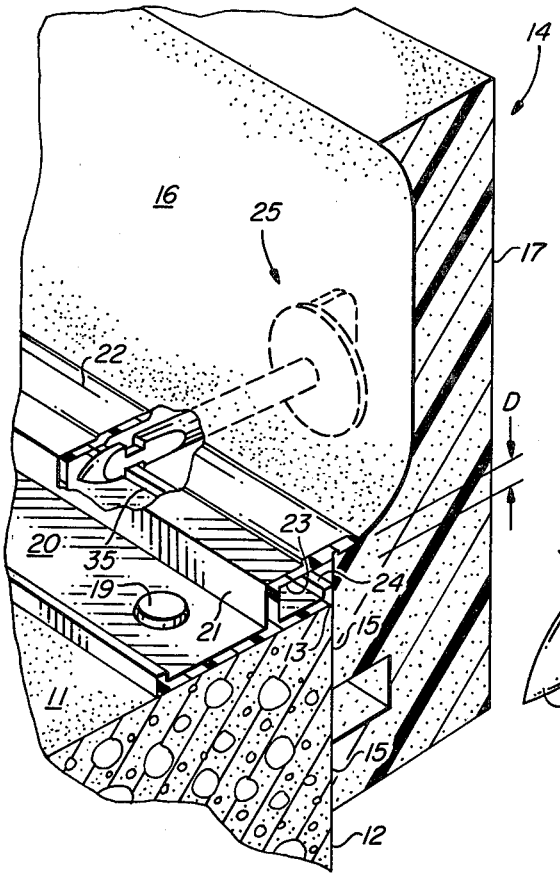
FIG. 1 is a perspective view of pool deck strip form apparatus constructed in accordance with the presently preferred embodiment of the invention and positioned adjacent the upper portion of a pool wall to support and contain poured concrete which, when hardened, forms the deck and associated coping of the pool.
Figure 4:
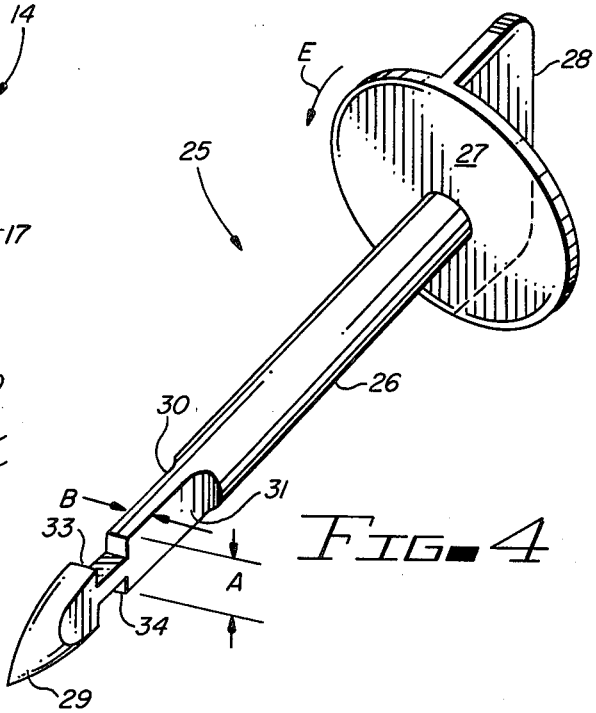
FIG. 4 is a perspective view of one element of the pool deck strip form apparatus of FIGS. 1 to 3.

Briefly, in accordance with my invention, I provide improved apparatus for forming the deck and associated coping of a pool. The pool defines and encloses a central area for receiving and retaining water and includes a substantially vertical wall; a generally horizontal support surface adjacent the vertical pool wall, the support surface and pool wall intersecting, terminating at and defining a generally horizontal edge, the edge being at the upper portion of the pool wall; a flexible sheet of waterproof material for lining the pool, the liner having a peripheral edge; and, a liner retainer secured to and extending continuously along the horizontal support surface adjacent the upper horizontal edge of the pool wall and having a channel extending along the length thereof contoured and dimensioned to receive the peripheral edge of the liner, the channel opening toward the central area of the pool. The improved apparatus includes a continuous strip of semirigid material including a facing surface, the facing surface being positioned below the horizontal edge against the upper portion of the pool wall, a front form surface extending upwardly from the facing surface to form a contoured surface for temporarily supporting concrete poured above the horizontal edge onto the horizontal support surface of the pool, the concrete forming a pool deck and coping contiguous to the pool wall when set, and a back wall surface generally opposed to the front form surface and facing the central area of the pool; and, an elongate support member having a first end shaped and contoured to pass through the strip of semirigid material and through the back wall surface and front form surface thereof and to be fixedly detachably secured in the liner retainer channel and, a second end provided with a head having an inner surface contoured to contact the back wall surface of the continuous semirigid strip and to hold the continuous strip in position against said upper portion of the pool wall when the first end is fixedly secured in the channel, the elongate member being under tension along at least a portion of the length thereof when the first end thereof is secured in the liner retainer channel and the head is contacting the back wall surface of the semirigid strip of material.

Turning now to the drawings, in which the presently preferred embodiments of the invention are shown for the purpose of illustrating the practice thereof and not by way of limitation of the scope of the invention, and in which like reference characters identify corresponding elements throughout the several views, FIGS. 1 to 4 illustrate pool deck strip form apparatus constructed in accordance with the presently preferred embodiment of the invention and including horizontal bonding surface 11 which terminates at and intersects with substantially vertical pool wall 12 to form horizontal edge 13 along the top of wall 11. Continuous strip form 14 includes generally flat facing surfaces 15 extending along and positioned against pool wall 12 and also includes upwardly extending, contoured form surface 16. Upstanding form surface 16 contains and supports poured concrete until the concrete has solidified to the point where strip form 14 can be removed. Back wall surface 17 of continuous strip 14 faces the central area of the pool and is generally opposed to faces 15 and 16. Pool liner strip 18 includes panel shaped base 20 extending along horizontal edge 13 and secured to bond surface 11 by nails 19. Upstanding elongate strip member 21 is connected to base 20 and carries horizontal panel member 22 which also extends along edge 13 of pool wall 11. Elongate strip members 21, 22 and a portion of base 20 define rectangular shaped channel 23, the longitudinal axis of which is generally parallel to edge 13. Channel 23 includes a continuous longitudinal slit 24 which opens toward the central area of the pool and is generally parallel to edge 13. Lip 35 upwardly depends from base 20 anf forms the lower edge of slit 24.

Key 25 includes elongate cylindrical neck 26 carrying and generally perpendicular to a head comprising circular panel member 27 provided with depending outwardly projecting finger tab 28. End 29 of neck 26 is tapered to a point. Near the distal end 29 of key 25 two sides of neck 26 are flattened to form a pair of planar surfaces 30, 31. U-shaped notches 33, 34 intersect planar surfaces 30, 31. The diameter of neck 26, indicated by arrows A, is greater than the height, indicated by arrows D, of opening 24 of channel 23. However, the width of the distal end of neck 26, indicated by arrows B, is less than the height of opening 24 of channel 23. Thus, end 29 of neck 26 can only be inserted a substantial distance into channel 23 by first rotating neck 26 and head 27, 28 in the direction of arrow E through an angle of 90° from the position of key 25 shown in FIG. 4. Once end 29 is inserted a substantial distance into channel 23, key 25 can be again rotated through an angle of 90° such that one of notches 33, 34 engages and interlocks with lip 35 and maintains key 25 fixedly, detachably engaged with channel 23. If liner strip were utilized which had a different configuration than strip 18 in FIGS. 1–3, the shape and dimensions of neck 26 and end 29 of key 25 would, of course, have to be appropriately adapted for use with that particular configuration.

Although key 25, strip 14 and liner strip 18 could each be fabricated from a variety of rigid or semirigid materials, in the presently preferred practice of the invention, strip form 14 is fabricated from polystyrene; key 25 is formed from substantially rigid plastic; and cove strip 18 is manufactured from a semirigid plastic.

Figure 2:
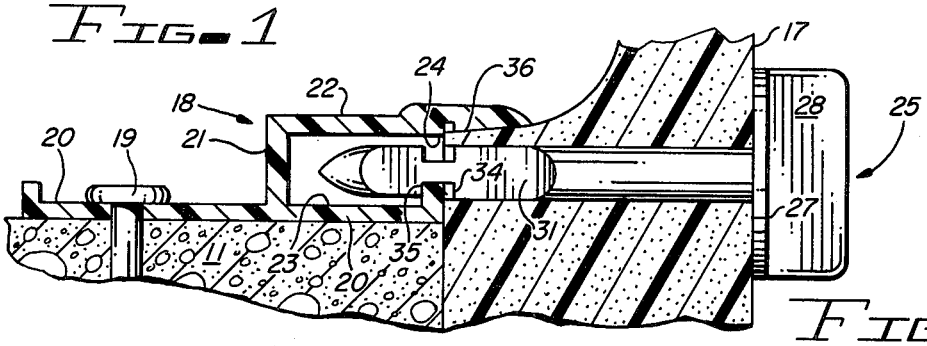
FIG. 2 is a side elevational view of the pool deck strip form apparatus in FIG. 1 further illustrating construction details thereof.
Figure 3:
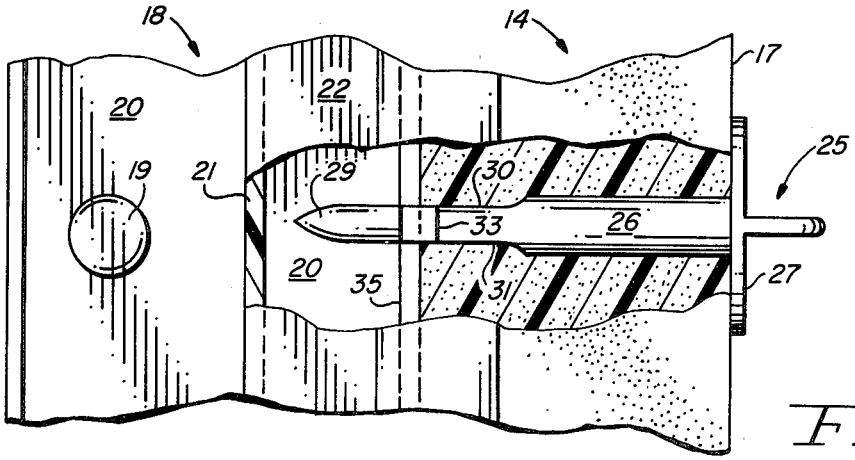
FIG. 3 is a top view of the pool deck strip form apparatus of FIG. 1 with a portion thereof broken away to further illustrate the construction thereof.

In use, pool wall 12 and horizontal support surface 11 are constructed. In pools which are intended to be lined with a sheet of waterproof, flexible material, wall 12 and horizontal support surface 11 extending along and around edge 13 are usually constructed of metal. However, in some instances, wall 12 and support surface 11 might be formed with concrete as shown in FIGS. 1 and 2. Liner strip 18 is secured to bond surface 11 with nails, adhesive or other fastening materials. Liner strips 18 can be produced in a wide variety of designs, but since the purpose of the strip is to provide a channel which receives the peripheral edge of the material used to line the pool, many, if not all liner strips have receiving channels which, as illustrated in FIGS. 1 and 2, generally open toward the central area of the pool.

Once liner strip 18 is fastened to horizontal support surface 11, facing surfaces 15 of polystyrene strip form 14 are positioned against the upper portion of pool wall 12 such that the upper lip 36 of strip form 14 rests against member 22 of liner strip 18 as shown in FIG. 2. Polystyrene strip 14 is punctured by pushing end 29 of key 25 through back wall 17 into strip 14 and through form surface 16 into channel 23. As earlier noted, key 25 must be rotated 90° from the position shown in FIG. 4 in order for the distal end 29 of key 25 to be able to pass through opening 24 into channel 23. Key 25 is dimensioned so that once panel member 27 contacts and is pressed against back wall 17 of polystyrene 14 the key can, by using finger tab 28, be rotated approximately 90° so that one of notches 33, 34 will engage lip 35 and maintain the distal end 29 of key 25 in engagement with liner strip 18. When end 29 fixedly engages liner 18, panel member 27 of key 25 presses against back wall 17 to maintain polystyrene strip 14 in position against wall 12. Keys 25 can be utilized at points spaced one to three feet apart along strip 14 or as otherwise desired.

After concrete has been poured and has sufficiently set, key 25 is rotated 90° in the direction of arrow E and disengaged from liner strip 18, allowing polystyrene strip 14 to be removed from pool wall 12 and discarded. The coping and pool deck formed by the concrete are then finish troweled by a mason. Keys 25 can be reused during the construction of another pool deck.

As described above, key 25 is operatively positioned by pushing end 29 through polystyrene strip 14. End 29 could also be passed through strip 14 via an aperture traversing the strip, especially if the strip form 14 were constructed of wood or other less penetrable material.

Strip form 14 is presently fabricated from a somewhat resilient polystyrene. Key 25 is dimensioned so that when end 29 is engaging lip 35 of liner strip 20 circular panel member 27 is tightly drawn against and compresses rear wall surface 17 such that the expansive forces of the slightly compressed polystyrene strip 14 act outwardly against panel member 27 causing member 27 to "pull" on and maintain neck 26 in tension.

Having described my invention in such terms as to enable those skilled in the art to understand and practice it, and having identified the presently preferred embodiments thereof, I claim:

1. An apparatus for forming a deck and coping thereof for a pool, said apparatus comprising, (a) a liner retainer strip having a channel extending along the length thereof contoured and dimensioned to receive the peripheral edge of a pool liner of flexible, waterproof material, said channel including a first elongate generally horizontally oriented inner surface extending along said liner retainer, a second elongate generally horizontally oriented inner surface extending along said liner retainer and generally parallel to said first elongate inner surface, a lip extending outwardly from said first elongate inner surface toward said second inner surface, the space between said lip and said second elongate inner surface representing a longitudinal channel opening facing said central area of said pool and extending along said liner retainer generally parallel to said pool wall, the vertical distance between said lip and said second inner surface generally being constant along the length of said retainer strip and being less than the vertical distance from said first inner surface to said second inner surface, (b) a continuous strip of semirigid material including (i) a facing surface free of adhesive and positioned below and horizontal edge against said upper portion of said pool wall, (ii) a front form surface extending upwardly from said facing surface to form a contoured surface for temporarily supporting concrete poured above said horizontal edge onto said horizontal support surface of said pool, said concrete forming a pool deck and coping thereof contiguous to said pool wall when set, and (iii) a back wall surface generally opposed to said front form surface and facing said central area of said pool, and (c) an elongate support member having (i) a first end shaped and contoured to pass through said strip of semirigid material and be fixedly detachably secured in said liner retainer, and (ii) a second end provided with a head having an inner surface contoured to contact said back wall surface of said continuous semirigid strip and to hold said continuous semirigid strip in position against said upper portion of said pool wall when said first end is fixedly secured in said liner retainer, said elongate member being under tension along at least a portion of the length thereof when said first end is secured in said liner retainer channel and said head is contacting said back wall surface of said semirigid strip of material.

2. The apparatus of claim 2 wherein said facing surface of said continuous strip of semirigid material is coated with adhesive.

3. The apparatus of claim 1 wherein at least one notch is formed in said first end of said elongate support member, said notch engaging said lip of said liner retainer when said first end is fixedly detachably secured in said liner retainer.

4. The apparatus of claim 3 wherein said first and of said elongate support member is shaped and dimensioned such that when said support member is oriented in a first operative position said first end may be inserted through said space between said lip and said second inner surface into said channel and rotated to a second operative position, said notch in said first end of said support member engaging said upstanding lip of said liner retainer when said support member is rotated from said first operative position to said second operative position, said end of said support member being prevented from being withdrawn from said channel when said support member is in said second operative position with said notch of said support member engaging said lip of said liner retainer.

5. The apparatus of claim 4 wherein said head is adapted to be manually grasped and rotated, the manual rotation moving said first end of said elongate support member between said first and second operative positions.

6. The apparatus of claim 5 wherein said facing surface of said continuous strip is provided with adhesive.

* * * * *

UNITED STATES PATENT AND TRADEMARK OFFICE

CERTIFICATE OF CORRECTION

PATENT NO. : 4,395,014

DATED : July 26, 1983

INVENTOR(S) : Max W. Deason

It is certified that error appears in the above-identified patent and that said Letters Patent are hereby corrected as shown below:

In Column 6, line 1, delete "said central area" and insert --the central area-- therefor.

In Column 6, line 3, delete "said pool wall" and insert --a wall of said pool-- therefor.

In Column 6, line 11, delete "and" and insert --the-- therefor.

In Column 6, line 11, insert --of and-- after the words "horizontal edge".

In Column 6, line 11, delete "said" and insert --the-- therefor.

In Column 6, line 16, delete "said horizontal" and insert --the horizontal-- therefor.

In Column 6, line 17, delete "of" and insert --around-- therefor.

Signed and Sealed this

*Eleventh* Day of *October 1983*

[SEAL]

*Attest:*

GERALD J. MOSSINGHOFF

*Attesting Officer*

*Commissioner of Patents and Trademarks*